US009763500B2

(12) United States Patent
Escobar

(10) Patent No.: US 9,763,500 B2
(45) Date of Patent: Sep. 19, 2017

(54) RING

(75) Inventor: Andrés Mauricio Zuluaga Escobar, Pinerolo (IT)

(73) Assignee: CINQUE S.R.L., Valenza (Alessandria) (IT)

( * ) Notice: Subject to any disclaimer, the term of this patent is extended or adjusted under 35 U.S.C. 154(b) by 13 days.

(21) Appl. No.: 14/415,421

(22) PCT Filed: Jul. 20, 2012

(86) PCT No.: PCT/IB2012/053707
§ 371 (c)(1),
(2), (4) Date: May 12, 2015

(87) PCT Pub. No.: WO2014/013296
PCT Pub. Date: Jan. 23, 2014

(65) Prior Publication Data
US 2015/0296932 A1 Oct. 22, 2015

(51) Int. Cl.
*A44C 9/02* (2006.01)
*A44C 9/00* (2006.01)
*A44C 17/02* (2006.01)

(52) U.S. Cl.
CPC ..... *A44C 9/00* (2013.01); *A44C 9/02* (2013.01); *A44C 17/02* (2013.01)

(58) Field of Classification Search
CPC ..... A44C 9/00; A44C 17/02
See application file for complete search history.

(56) References Cited

U.S. PATENT DOCUMENTS 8,573,004 B2 * 11/2013 Demeglio ..... A44C 9/02 63/15.6
2009/0056373 A1 3/2009 Czajka et al.

FOREIGN PATENT DOCUMENTS

WO 2006/078693 A2 7/2006

OTHER PUBLICATIONS

International Search Report for International Application No. PCT/IB2012/053707; two pages; mailed Apr. 19, 2013.

* cited by examiner

*Primary Examiner* — Jack W Lavinder
(74) *Attorney, Agent, or Firm* — Vorys, Sater, Seymour and Pease LLP

(57) ABSTRACT

Provided is a ring including at least one crown; and angular sectors disposed circumferentially contiguous and substantially inside the crown and configured to be translated along substantially radial sliding axes defining a contracted configuration in which the angular sectors are mutually in contact so that the ring defines an inner diameter of minimum value; and at least one expanded configuration in which the angular sectors are spaced apart so that the inner diameter of the ring has a value greater than the minimum value.

10 Claims, 2 Drawing Sheets

Figure 1B:
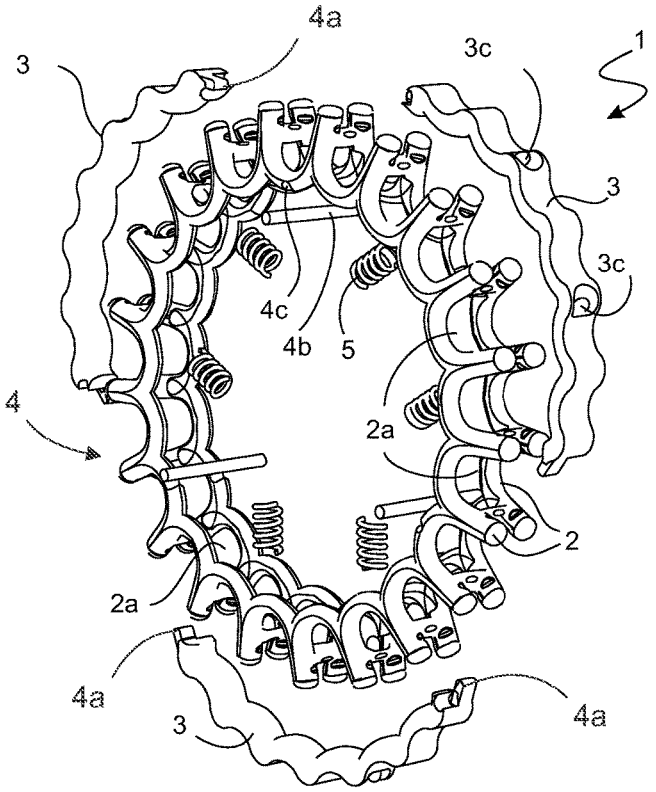

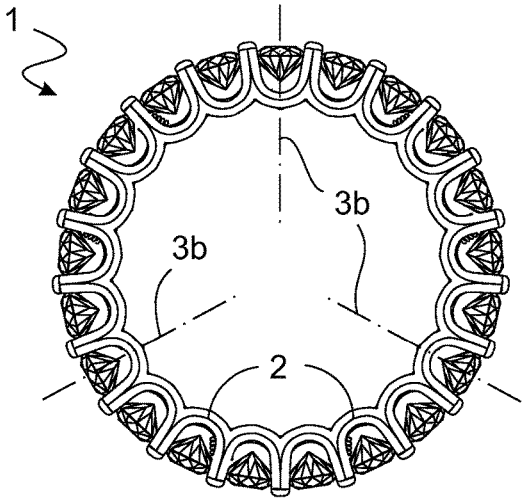
Fig. 2a
Fig. 2b
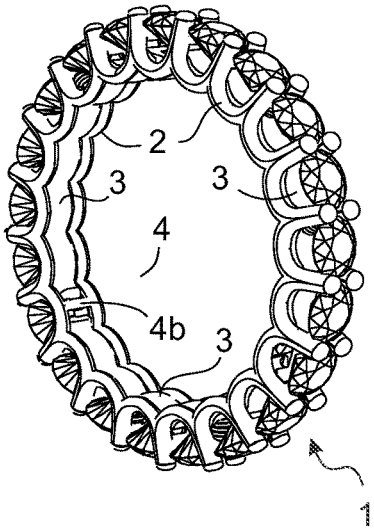
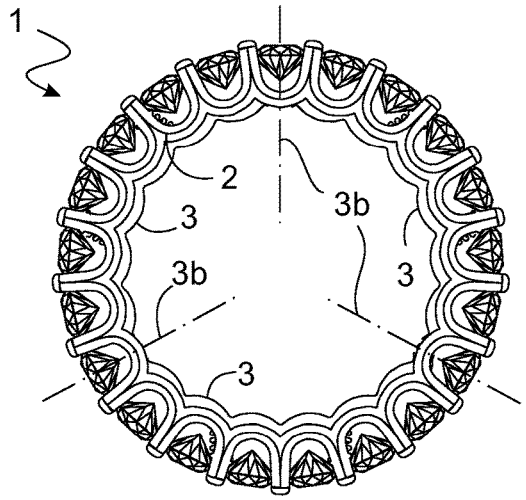
Fig. 3a
Fig. 3b
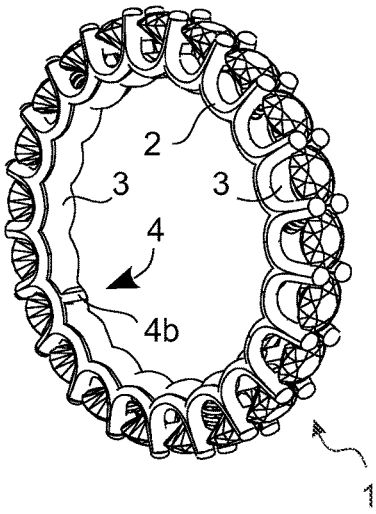

RING

The present invention relates to a ring of the type pointed out in the preamble of the first claim.

It is known that presently rings are classified not only taking into account their shape, material and stones, but also based on their inner diameter, so that, depending on the finger size, it is possible to chose the ring that is the most appropriate to the user.

In particular, this choice is very important because a ring having a wrong inner diameter gives rise to many non negligible problems.

More specifically, if the inner diameter is too small, wearing of the ring becomes particularly bothersome and in some cases it is impossible to wear it as the ring cannot be slipped on the user's finger. On the contrary, if the inner diameter is too big, the ring does not remain conveniently fixed on the finger so that it appears to be unpleasantly unstable and in some cases it may even accidentally slip off the finger.

Often, in spite of an initial accurate choice of the ring, the finger may modify its size so that a ring, at the beginning perfectly fitting the user's finger, it is no longer so, and it becomes uncomfortable to wear it.

In addition, some people provided with particularly big knuckles relative to the phalanxes' body find it difficult to wear rings.

In an attempt to solve this problem, solutions have been conceived that modify the inner diameter of the ring thus enabling it to be adjusted to the new sizes of the finger.

A first solution consists in working operations carried out by the jewelers which are adapted to modify the inner diameter of the ring, such as removal/addition of material or heating and beating, for example.

Another solution contemplates use of an annular structure adapted to be internally associated with the ring and comprising tabs having a proximal end fixedly secured to the inside of the annular structure and a distal end, suitably spaced from the structure itself, that will define a smaller inner diameter for the ring, and torsion springs fastened close to the proximal end and adapted to move the distal end away from the ring.

In this case, when the ring is worn, the distal end coming into contact with the finger, is pushed by the finger itself so that the tab rotates against the action of the torsion springs, moving the distal end close to the ring and then resting on the finger.

The known art mentioned above has some important drawbacks.

A first drawback belonging above all to the jeweller's working operations is represented by the fact that they modify the aesthetics of the ring and therefore cause decay of the quality.

Another defect of these working operations is that they do not allow the ring to be adapted to subsequent changes in the finger's sizes. In particular if, once the working operations have been completed, the finger changes its sizes again, it is not possible to re-adapt the ring to the finger and new working operations are made necessary, which will bring about further aesthetic decay in the ring quality.

Another problem of these working operations is that, when enlargements exist at the end of the first phalanx, wearing of the ring is uncomfortable because engagement of the ring with the finger does not take place in a correct manner, due to the smaller section of the central part of the first phalanx relative to the phalanx end.

An important problem connected with known adjustment devices is represented by the fact that, when the ring is not worn, the tabs, due to the action of the torsion springs, project from the annular structure giving the ring a low quality appearance.

Furthermore, if deformation of the tabs does not enable them to perfectly lay on the annular structure, said tabs space out the ring from the finger and consequently cause worsening in the ring aesthetics.

Another problem of these devices resides in that these tabs exerting pressure on the finger give the ring a low comfort sensation.

Under this situation, the technical task underlying the present invention is to conceive a ring capable of substantially obviating the mentioned drawbacks.

Within the scope of this technical task, it is an important aim of the invention to conceive a ring that is able to adapt itself to the finger without, for that reason, reducing its aesthetic quality.

Another important aim of the invention is to obtain a ring capable of fitting fingers of different sizes while at the same time always giving a high sensation of comfort.

The technical task and the aims specified are achieved by an adjusting device for a ring as claimed in the appended claim 1.

Preferred embodiments are highlighted in the sub-claims.

Figure 1A:
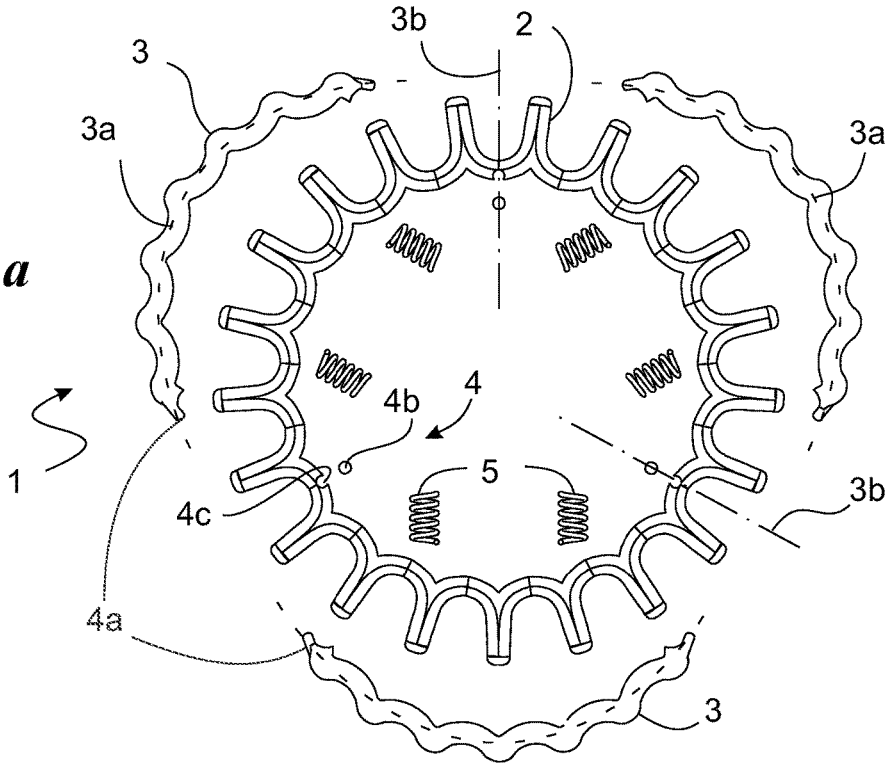

The features and advantages of the invention are hereinafter clarified by the detailed description of a preferred embodiment of the invention, with reference to the accompanying drawings, in which:

FIG. 1*a* is an exploded front view of a ring according to the invention;

FIG. 1*b* is an exploded axonometric view of FIG. 1*a;*

FIG. 2*a* shows a first configuration of the ring according to the invention;

FIG. 2*b* shows the configuration of FIG. 2*a* in an axonometric view;

FIG. 3*a* shows a second configuration of the ring according to the invention; and FIG. 3*b* shows the configuration of FIG. 3*a* in an axonometric view.

With reference to the drawings, the ring according to the invention is generally identified with reference numeral 1.

Ring 1 comprises at least one crown 2, usually made of precious material; a plurality of angular sectors 3 substantially placed inside the crown 2; and, in some cases, one or more precious stones 4 suitably fastened to the crown 2. Sectors 3 are suitably disposed circumferentially contiguous and, in particular, they define preferred substantially arched extension directions 3*a* that, preferably, practically lie in the same circumference so that sectors 3 substantially define an annulus.

They are at least partly housed inside a collecting space 2*a* formed at the inner face of crown 3 or, should the ring be provided with two or more suitably spaced crowns 11, defined by the space contained between two crowns 11.

The angular sectors 3 further have a profile substantially coincident with that of crown 2 and are made of elastomer or, preferably, the same material of which the ring 1 is made, i.e. gold, silver or other precious metal.

They are advantageously mutually movable along substantially radial sliding axes 3*b* so as to translate relative to the collecting space 2*a* and define a contracted configuration (FIGS. 3*a* and 3*b*) in which the angular sectors 3 protrude at least partly from crown 2 and are almost mutually in contact so that the ring 1 has an inner diameter of minimum value; and at least an expanded configuration in which the angular sectors 3 are spaced apart so that the ring 1 has its maximum inner diameter that is larger than said minimum value.

In particular, the angular sectors 3, by translating along the sliding axes 3*b*, further define a maximum expanded configuration (FIGS. 2*a* and 2*b*), in which sectors 3 are almost fully housed inside the collecting space 2*a* and therefore ring 1 has an inner diameter of maximum value, i.e. substantially the same as the inner diameter of crown 2.

In order to ensure said translation along the sliding axes 3*b* while changing their configuration, ring 1 comprises one or more guides 4 adapted to impose this translation to the angular sectors 3 along axes 3*b*.

Guides 4 comprise at least one sliding tooth 4*a* protruding from an angular sector 3 and a conduction retainer 4*b*, a pin for example, along which the tooth 4*a* slides and adapted to be secured to crown 2, preferably by welding of a rod portion of bigger sizes than the axial size of ring 1 and subsequent cutting of said rod, at a housing 4*c* formed along the collecting space 2*a*. Alternatively, the conduction retainer 4*b* and crown 2 are of one piece construction.

Each guide 4 has two engagement teeth 4*a* protruding from the ends of contiguous angular sectors so that, during variation of the configuration, the teeth simultaneously slide along a single conduction retainer 4*b*.

The engagement teeth 4*a* define an extension direction substantially coincident with the extension direction 3*a* or, alternatively, an extension direction externally diverging relative to the preferred extension direction 3*a*, i.e. external to the circumference defined by the extension directions 3*a*.

In addition, they have sizes, in the direction of the central axis of ring 1, smaller than that of the angular sectors. Preferably, the engagement teeth 4*a* have said sizes smaller than half the size of the angular sectors 3 so that the engagement teeth 4*a*, belonging to contiguous angular sectors 3, are adapted to be at least partly superposed in the circumferential direction and, in particular, to be fully superposed in the contracted configuration bringing the angular sectors 3 substantially in contact with each other.

Finally, ring 1 comprises elastic means 5 adapted to vary the configuration of ring 1 by moving the angular sectors 3 along the sliding axes 3*b* and to be secured to the angular sectors 3 so as to be interposed between crown 2 and the angular sectors themselves 3. In particular, ring 1 for each angular sector 3, provides for the presence of two elastic means that are suitably disposed almost in mirror image relationship relative to the center of gravity of the angular sectors 3.

The elastic means can be springs, preferably compression springs, adapted to enable the ring to go back to the contracted configuration by moving the angular sectors 3 along the sliding axes 3*b*.

These means are associated with the angular sectors 3 through partial insertion into seats 3*c* formed at the surfaces of sectors 3 proximal to crown 2 or, alternatively, through a peg protruding from these proximal sectors so as to be engaged with the elastic means 5 themselves.

In addition, to ensure the correct action of the elastic means 5, said means 5 can be partly inserted in additional seats formed in crown 2 and, in particular, formed at the collecting space 2*a*.

Operation of a ring, described above in terms of structure, is the following.

At rest, ring 1 is in the contracted configuration, i.e. the angular sectors 3 are substantially in contact with each other and at least partly protrude from the collecting space 2*a* so that ring 1 has the inner diameter of minimum value.

When the operator wears the ring 1, if the finger substantially has the same diameter as the minimum value of the inner diameter of ring 1, the ring is fitted and maintains the contracted configuration.

Alternatively, if the finger has a greater diameter than the minimum value, the angular sectors 3, pushed by the finger, translate along the sliding axes 3*b* causing passage to an expanded configuration, i.e. the value of the inner diameter of ring 1 increases.

In particular, the angular sectors 3, due to contact between the latter and the finger, move along the sliding axes 3*b* against the action of the elastic means 5 so that they are further inserted into the collecting space and therefore determine an increase in the inner diameter relative to the minimum value belonging to the contracted configuration.

More particularly, if the finger has a diameter substantially coincident with that of crown 2, ring 1 goes to the configuration of maximum expansion at which the angular sectors 3 are almost fully housed and the inner diameter of the ring takes the maximum value.

Finally, ring 1, when it is removed from the finger, goes back to the contracted configuration due to the elastic means 5 that, after being compressed during passage to the expanded configuration, release their energy and translate the angular sectors 3 thus bringing them back substantially in contact with each other.

The invention enables important advantages.

A first important advantage is represented by the fact that, due to the particular movements of the angular sectors 3, ring 1 is able to adapt itself to the variations in size to which a finger may be submitted.

Another advantage resides in that, even when the end of the first phalanx has an enlargement relative to the central part of the same phalanx, ring 1 is able to perfectly adapt itself to the finger.

In fact, due to translation of the angular sectors 3 along the sliding axes 3*b* and to the presence of the elastic means 5, ring 1 is able to increase its inner diameter so as to pass the enlargement and then reduce it again so as to perfectly fit the finger at the central part of the first phalanx.

Another advantage is represented by the fact that, since the angular sectors 3 have a profile substantially coincident with that of crown 2, ring 1 has particularly high quality and value features.

In particular, should ring 1 be disposed in the maximum expanded configuration, sectors 3 will be almost fully housed in the collecting space 2*a* so that they are fully concealed to the sight and therefore ring 1 has the original proportions and consequently the maximum value and quality.

This quality feature is further increased by the fact that the angular sectors 3 are made of precious metal.

In particular, the presence of sectors 3, as they are made of the same material as crown 2 and have a profile substantially coincident with that of said crown 2, does not give rise to variations in the aesthetics of the ring that therefore always remains of particularly high value.

A further advantage resulting from the particular profile of the angular sectors 3 is that said sectors, compared with the presently used tabs, define a particularly extended contact surface with the finger so that they are able to give a high sensation of comfort when ring 1 is worn.

The invention is susceptible of variations falling within the scope of the inventive idea. All the described and claimed elements can be replaced by equivalent elements and the details, materials, shapes and sizes can be of any nature and magnitude.

The invention claimed is:

1. A ring, comprising:

a crown defining a collecting space;

a plurality of angular sectors disposed circumferentially contiguous and substantially inside said crown and configured to be at least partly housed in said collecting space, each of said plurality of angular sectors including an engagement tooth protruding from each end of said angular sector, wherein said ring comprises at least two guides configured to enable said plurality of angular sectors to translate along substantially radial sliding axes defining a contracted configuration in which said plurality of angular sectors define an inner diameter of said ring of minimum value and said plurality of angular sectors are almost in mutual contact, and at least one expanded configuration in which said plurality of angular sectors define an inner diameter of said ring of maximum value, and wherein each of said at least two guides comprise a pin extending in an axial direction and secured to said crown, and at least one said engagement tooth from each end of adjacent said plurality of angular sectors configured to slide along said pin.

2. The ring as claimed in claim 1, wherein said plurality of angular sectors, while translating along said sliding axes, define a maximum expanded configuration in which said angular sectors are substantially fully housed inside said collecting space and said inner diameter of said ring is substantially the same as an inner diameter of said crown.

3. The ring as claimed in claim 1, wherein said pin is secured to said crown at said collecting space.

4. The ring as claimed in claim 1, wherein said pin is secured to said crown by friction fit.

5. The ring as claimed in claim 1, further comprising elastic means interposed between said crown and each of said plurality of angular sectors so as to allow movement of said plurality of angular sectors substantially along said sliding axes.

6. The ring as claimed in claim 5, wherein each of said plurality of angular sectors comprise at least one seat configured to partly house said elastic means.

7. The ring as claimed in claim 5, wherein said elastic means are configured to bring said ring to said contracted configuration.

8. The ring as claimed in claim 5, wherein said elastic means are compression springs.

9. The ring as claimed in claim 1, wherein said at least one engagement tooth defines an extension direction substantially coincident with the extension direction of said angular sectors.

10. The ring as claimed in claim 1, wherein said engagement teeth, have sizes, in the direction of the central axis of said ring, smaller than half the size of said angular sectors so that the engagement teeth, belonging to contiguous angular sectors, are adapted to be at least partly superposed in the circumferential direction.

* * * * *